US005524324A

United States Patent [19]

Kunkel

[11] Patent Number: 5,524,324

[45] Date of Patent: Jun. 11, 1996

[54] DOOR HINGE WITH AN INTEGRATED LOCKING DEVICE

[75] Inventor: Philipp Kunkel, Weinstrasse, Germany

[73] Assignee: Mussbach Metall Hackelsberger GmbH & Co., Weinstrasse, Germany

[21] Appl. No.: 424,250

[22] Filed: Apr. 19, 1995

[51] Int. Cl.[6] ..... F05D 11/06; F05D 11/10

[52] U.S. Cl. ..... 16/334; 16/321; 16/374; 16/385

[58] Field of Search ..... 16/321, 333, 334, 16/335, 344

[56] References Cited

U.S. PATENT DOCUMENTS

| | | | |
|---|---|---|---|
| 3,070,829 | 1/1963 | Peras | 16/319 |
| 3,370,317 | 2/1968 | Marchione | 16/308 |
| 3,408,684 | 11/1968 | Marchione | 16/334 |
| 3,431,589 | 3/1969 | Frey | 16/334 |
| 3,434,179 | 3/1969 | Marchione | 16/334 |
| 4,285,098 | 8/1981 | Hicks et al. | 16/308 |
| 4,532,675 | 8/1985 | Salazar | 16/335 |
| 4,932,101 | 6/1990 | Lualdi | 16/334 |
| 5,235,726 | 8/1993 | Geier | 16/334 |

FOREIGN PATENT DOCUMENTS

0520358A1 6/1992 European Pat. Off. .

*Primary Examiner*—M. Rachuba
*Assistant Examiner*—Donald M. Gurley
*Attorney, Agent, or Firm*—Barnes & Thornburg

[57] ABSTRACT

A door hinge with an integrated locking device for yielding positioning of a door at predetermined angles relative to a frame of a motor vehicle comprising: a first hinge part having a base part, a bending spring with three U-shaped sections mounted on the base plate of the first hinge part, a second door-side hinge part having rotatably disposed rollers thereon and wherein the rollers deform the bending spring when the second hinge part is swivelled relative to the first hinge part.

14 Claims, 3 Drawing Sheets

DOOR HINGE WITH AN INTEGRATED LOCKING DEVICE

BACKGROUND OF THE INVENTION

The invention relates to door hinges with integrated locking devices, particularly for doors of motor vehicles having a door hinge with an integrated locking device for yielding positioning of a door at predetermined angles relative to a frame comprising:

a first hinge part having a base plate with integral, upstanding legs;

a bending spring;

a second door-side hinge part having plural rollers attached thereto in a rotatable manner;

a hinge shaft for rotatably securing the second hinge part to the first hinge part; and wherein one of the plurality of rollers deforms the bending spring when the second hinge part is swivelled relative to the first hinge part.

Doors of motor vehicles are normally each fastened by two hinges on the frame of a motor vehicle and generally have at least one locking device which permits the opening or closing of the door against a predetermined resistance. The hinge maintains the door at certain preferred positions during the opening or closing and provides resistance to movement so that the doors can be moved only with an increased expenditure of force.

U.S. Pat. No. 4,532,675 discloses a door hinge with an integrated locking device by which a door of a motor vehicle can be held in an open position. This hinge contains first and second hinge parts which are swivelled relative to one another about a joint axis of rotation. The integrated locking device contains a bending spring on a first hinge part and a roller on a complementary second hinge part. The bending spring is mounted in a prestressed manner on a base plate of the first hinge part and is bent away from the base plate. In order to ensure a sufficient spring travel at the point at which the bending spring interacts with the roller, the bending spring must be located from the base plate by a large distance. Thus, the distance of the roller on the second hinge part and the distance of the axis of rotation from the plane of the base plate of the first hinge part will also become large. The mounting of the bending spring under prestress requires high machining expenditures, particularly when the locking device is to be retrofitted after the door is mounted. The free length of the bending spring is relatively short so that bends occur over a short distance which results in a susceptibility to breakage of the bending spring. This prior art does not contain an intermediate position from which a half-opened door can be moved with an increased expenditure of force.

European Patent Document EP-A 92 110 525.0 shows a door hinge for a motor vehicle with an integrated locking device which can be held in two positions or different angles during an opening or closing. The locking device contains a pressure spring on a first hinge part and two rollers on the complementary second hinge part. The spring is bent about a base plate and is bent away from this base plate. This arrangement is expensive to produce because of its complicated spatial structure. The part of the pressure spring bent away from the base plate, as in the above-mentioned U.S. patent document, results in an increased distance of the roller. This requires an increased distance of the joint axis of rotation from the plane of the base plate from which the forces are transmitted from the door to the door hinge. This distance also increases the amount of the torque on the hinge parts, when large forces occur on the door, as well as a large tension in the hinge parts. Thus, such a design requires sufficient fatigue strength which can be achieved only by expensive high-strength materials or very large material thicknesses. The elastic length of the pressure spring of this known door hinge is limited by the dimensions of the base plate on which the pressure spring is supported.

These known door hinges have springs, whose elastic lengths are limited, which results in unfavorable spring characteristics and to increased susceptibility to breakage. The relatively large distances of the common axes of rotation of the hinge parts, from the mounting and force introduction points on the door, cause the forces introduced by the doors to produce high torque on the hinge parts. Since, with growing safety requirements which, for example, increase the demands for protection against a lateral impact, the demands for strength of door holding devices are also increasing. The ability to avoid high torques by an optimized constructive design of the hinge parts gains in significance. The springs according to the above-mentioned state of the art have complicated spatial structures which result in high manufacturing costs for the bending springs.

With narrow space conditions between the door and the frame of the motor vehicle, the above-mentioned door hinges are difficult to mount. In the situation with a mounted door, the locking devices of these known door hinges cannot be retrofitted separately, since the necessary high prestresses cannot be applied to the springs. So, for these known door hinges, it is most difficult or impossible to use them for spare parts or in replacement situations.

These known door hinges are made of milled and/or stamped steel profiles which are expensive to manufacture so that, for small orders, these known door hinges cannot be used or are not economical to use.

It is therefore an object of the instant invention to provide a door hinge with an integrated locking device which has a high stability and fatigue strength while mounting characteristics are favorable and the manufacturing costs are low.

This object is achieved by a door hinge with an integrated locking device for yielding positioning of a door at predetermined angles relative to a frame comprising: a first hinge part having a base plate with integral, upstanding legs; a bending spring; a second door-side hinge part having plural rollers attached thereto in a rotatable manner; a hinge shaft for rotatably securing the second hinge part to the first hinge part; wherein one of the plurality of rollers deforms the bending spring when the second hinge part is swivelled relative to the first hinge part; wherein the bending spring is configured to have three U-shaped sections, a first U-shaped section comprising a transverse section and two parallel legs adjoining the transverse section at an approximate angle of 90°, a second U-shaped section connected to one of the parallel legs and configured with a 180° bend and an end leg extending therefrom, and a third U-shaped section connected to the other parallel leg and configured with a 180° bend and an end leg exending therefrom; wherein the parallel legs of the bending spring extend essentially parallel to sides of the base plate of the first hinge part; and wherein the bending spring is mounted to the first hinge part in an unstressed condition.

It is also advantageous if the bending spring extends in a single plane; if the end legs of the bending spring are parallel to one another in grooves in the base plate, and the two parallel legs are spaced farther from one another than the end legs and centered around the base plate; if the second hinge part is equipped with at least two rollers, which are each rotatably disposed therein; if the second hinge part has stops which contact the upstanding legs of the base plate when the door is completely open; if the first hinge part is made of any one of plastic or sintered metal; if the second hinge part is fixedly clamped by means of a conical hinge shaft in a bore with a cone of the first hinge part; if the ends less the bending spring are surrounded by self-lubricating metalloplast bushes in grooves on the first hinge part; if the bending spring is detachably connected to the base plate of a holding device; or if the base plate has grooves for receiving bushes holding the ends of the bending spring and the edges of the grooves are deformed after insertion of the ends of the bending spring, surrounded by bushes, so that the bending spring is fixedly held in the grooves.

The door hinge with the integrated locking device is equipped with a bending spring which is guided such that relatively large "free lengths" occur between bearings on ends of the bending spring in an essentially plane base plate of a first hinge part and with the introduction of force from rollers of a second hinge part. When the second hinge part is rotated relative to the first hinge part, forces and deformations can be carried away by the bending spring along relatively long paths which results in an improved springing action and a longer durability of the bending spring. The characteristic shape of the bending spring permits a compact construction of the door hinge so that small installation irregularities can be compensated for. Therefore, the rollers on the second hinge part and, hence, the common axis of rotation of the hinge parts can be mounted at a reduced distance with respect to the plane of the base plate. The overall spring force of the bending spring is predominantly the result of bending of a transverse section, the legs and the free ends of the bending spring and, to a negligible extent, on the torsion in bends of the bending spring. The bending spring can be fastened on the first hinge part without prestress, whereby the retrofitting of locking devices on already mounted doors is facilitated.

The bending spring of the door hinge with the locking device is preferably flat since the manufacturing of flat bending springs requires a lower cost and is therefore more reasonable with respect to the cost of manufacturing spatially curved springs. The flat bending spring promotes a compact construction of the door hinge.

The arrangement of the legs of the bending spring in parallel to two sides of the base plate and the arrangement of a transverse section of the bending spring which is in parallel to one side of the base plate and closely adjacent the first hinge part permits a very compact construction of the door hinge with an integrated locking device.

By utilizing two rollers, three positions of the door can be established: a first position in which the door is closed; a second position in which the door takes up a defined center position; and a third position in which the door is fully opened. By utilizing more rollers than in the preferred embodiment, correspondingly more positions of the door can be established. The positions and geometries of the rollers determine the resistance forces on the vehicle door.

According to an advantageous development of the invention, the second hinge part is equipped with stops which, when the door is fully open, are placed against the legs of the base plate of the first hinge part and prevent a further open swivelling of the door caused, for example, by a gust of wind. According to the invention, in the position of the fully opened door, a stable condition will automatically occur because the bending spring will still be acting on one of the rollers, preferably the smaller roller, and will press the stops of the second hinge part against the legs of the base plate of the first hinge part.

A cast material can be used for the hinge parts and particularly the base plate which process requires lower tool costs for manufacturing and therefore permits the manufacturing of smaller piece numbers in a cost effective manner.

According to another advantageous development of the invention for a lift-off system, the hinge parts of the door hinge are connected with one another in an easily detachable manner. For mounting or demounting, the door must only be lifted in or out and will center automatically after the mounting. The lift-off system is-particularly advantageous for the installation of mounting systems, such as window lift mechanisms, loudspeakers, etc. into a vehicle door because, herein, the vehicle door is normally dismounted after being painted. The lift-off system permits a simple facilitated reinstallation of the vehicle door in the fabrication process without the requirement of a repeated adjusting of the vehicle door during the reinstallation. The mounting takes place in the so-called center catch position of the vehicle door in which the bending spring is not stressed.

In order to further improve the fatigue strength of the locking device of the door hinge, it may be advantageous to dispose the bending spring in a sleeve so that tensions, particularly at the edge of the bearing and the susceptibility to breakage of the bending spring are reduced. In principle, the bearing may be implemented without any sleeve.

According to a particularly advantageous development of the invention, the bearing of the bending spring is detachable so that the mounting of the bending spring is facilitated.

According to an alternative development of the bearing of the bending spring, the bending spring is secured to the base plate by deforming an edge of the base plate over the spring so that a firm securement is obtained with low construction expenditures and few component parts.

According to another advantageous development, the bending spring is held in an adjustable manner so that the locking device can be adapted to different requirements and vehicle models.

According to the invention, the rollers can be constructed of a self-lubricating material so that the rollers operate with reduced noise. Here, the shafts of the rollers should not be surrounded with a bearing material.

The door-side hinge part may be provided with a detachable mounting plate for fastening the door-side hinge part to a vehicle door.

Other objects, advantages and novel features of the present invention will become apparent from the following detailed description of the invention when considered in conjunction with the accompanying drawings.

DETAILED DESCRIPTION OF THE DRAWINGS

Figure 1:
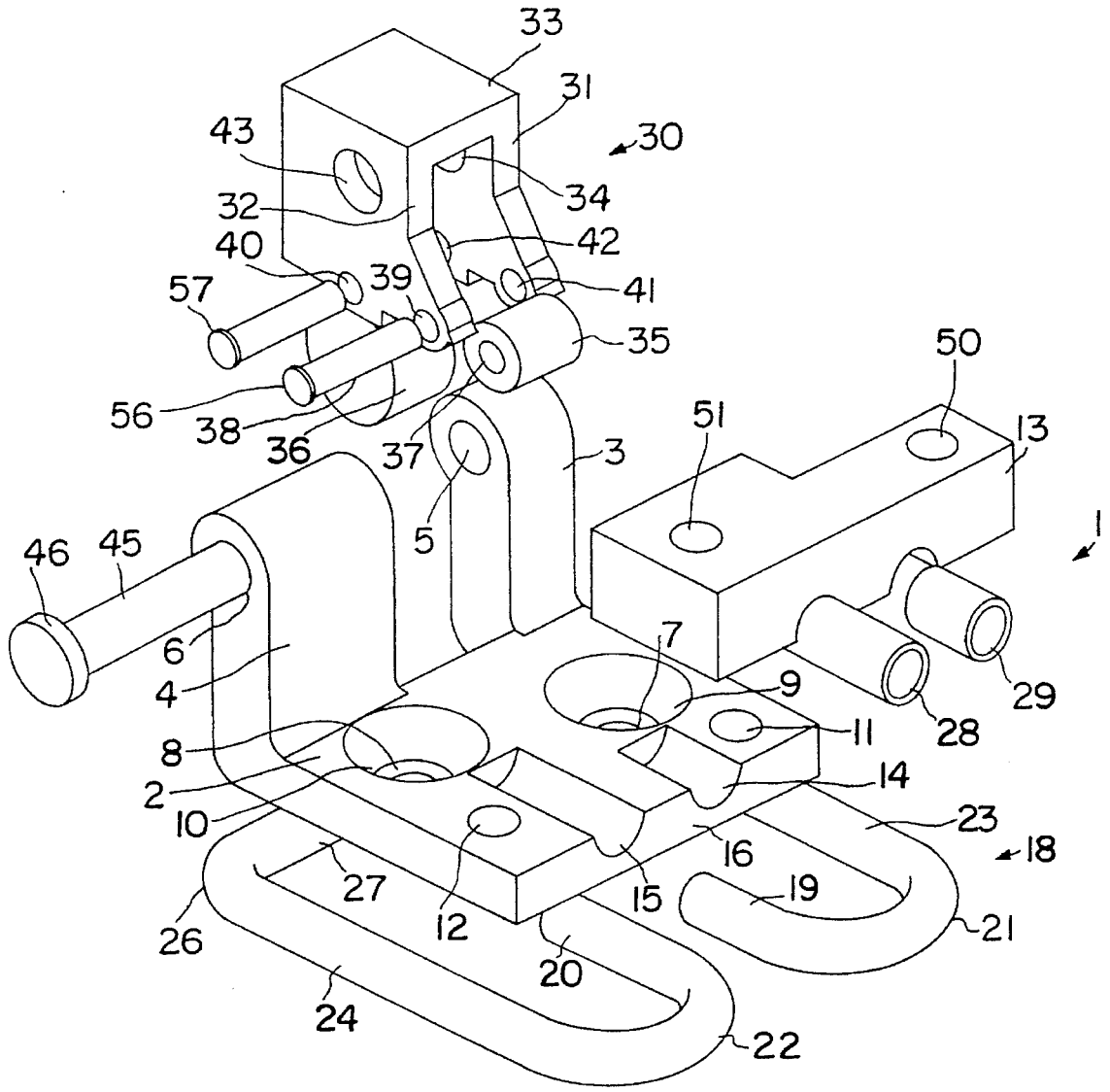
FIG. 1 is an exploded view of the main elements of the door hinge with the locking device according to the invention.
Figure 2:
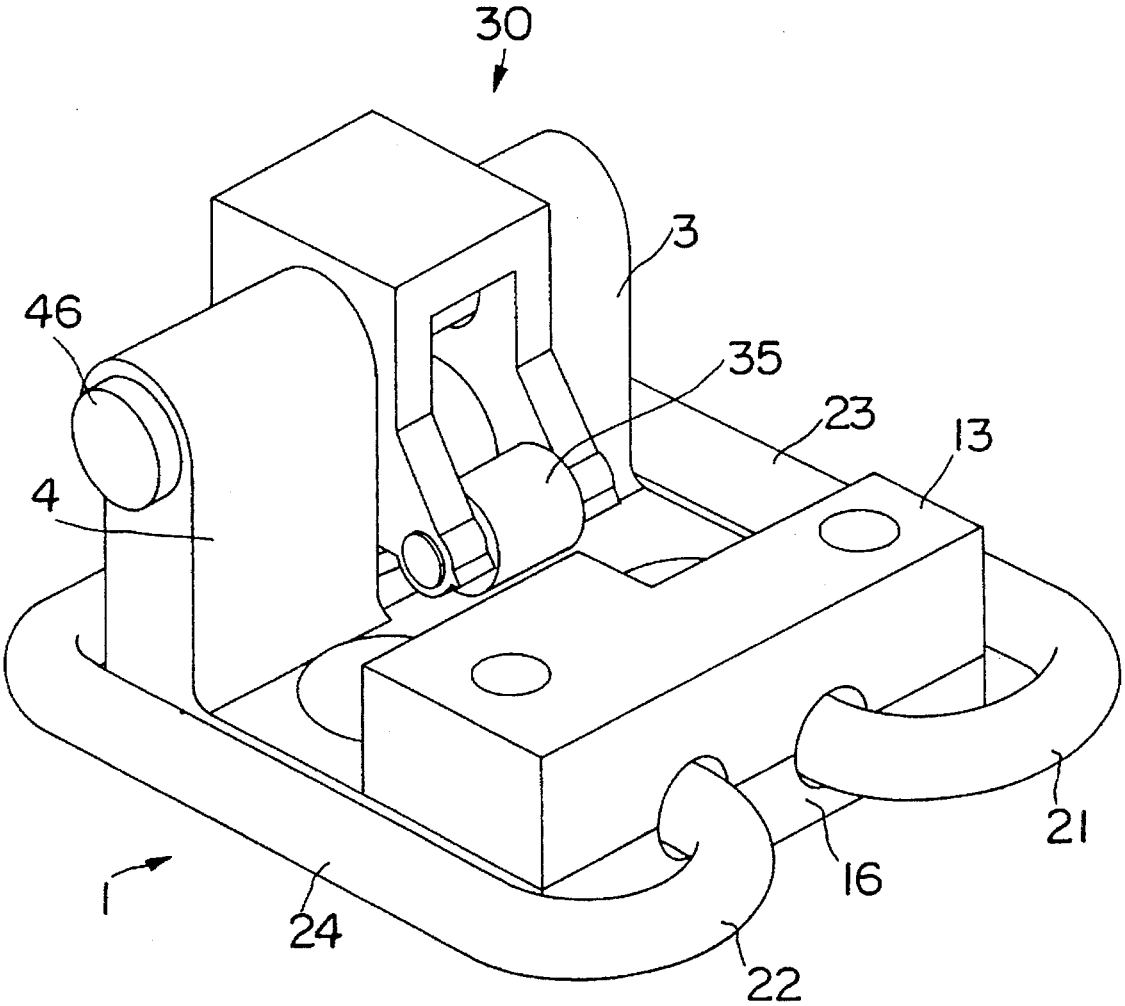
FIG. 2 is a view of the assembled door hinge according to claim 1.

FIGS. 1, 2 show a door hinge with an integrated locking device. A first hinge part 1 preferably has a rectangular base plate 2 and two legs 3, 4 essentially perpendicular to the base plate 2. The base plate 2 is plane and has a coplanar top and bottom surfaces. The legs 3, 4 form one piece with the base plate 2, are in parallel to one another and, on their free ends, have coaxial bores 5, 6 which extend in parallel to the base plate 2. The hinge part 1 is preferably made of cast steel.

The base plate 2 is provided with bores 7, 8 for the mounting of the hinge part 1 on a frame (not shown) of a motor vehicle. The bores 7, 8 are each provided with a chamfer 9, 10 in the form of a conical widening of the bores 7, 8 so that conical screw heads of special fastening screws (not shown) can be introduced into the bores 7, 8 for fastening and centering of the door hinge. However, according to the invention, the base plate 2 may be connected with the frame in another locking manner, for example by welding.

Bores 11, 12 are used for mounting a holding device 13 by screws (not shown). Between the bores 11, 12, the surface of the base plate 2 is provided with cylindrical grooves 14, 15. The cylindrical grooves 14, 15 are in parallel to one another, in parallel to the surface of the base plate 2 and perpendicular to one side 16 of the base plate 2.

A bending spring 18 has two free ends 19, 20 which are situated in parallel to one another in a plane. From the ends 19, 20, 180°-bends 21, 22 lead to parallel legs 23, 24 of the bending spring 18. The legs 23, 24 are separated from one another more than the free ends 19, 20 of the bending spring 18. 90°-bends 25, 26 lead from the legs 23, 24 to a transverse section 27 of the bending spring 18. After mounting, the bending spring 18 extends in close contact around the base plate 2 of the hinge part 1 (see FIG. 2). The bending spring 18 is preferably manufactured of a steel alloy with a high modulus of elasticity. Self-lubricating metalloplast bearing bushes 28, 29 can be used to accommodate the free ends 19, 20 of the bending spring 18.

Preferably, the free ends 19, 20, the 180°-bends 21, 22, the legs 23, 24, and the transverse section 27 of the bending spring 18 are situated in one plane. However, it is also within the scope of the invention to set the bending spring 18 at the bends 21, 22 at a 2°–3° angle so that the plane of the free ends 19, 20, together with the plane of the legs 23, 24 and of the transverse section 27 of the bending spring 18, enclose an angle of 2°–3°.

A second hinge part 30 is provided with a mounting plate 55 (see FIG. 3) for fastening to a door of a motor vehicle. With parallel side walls 31, 32 and cover surface 33, the second hinge part 30, is essentially in the shape of a cube. The mounting plate 55 is preferably fastened to a cover surface of the second hinge part 30, or is manufactured as a stamped part, in one piece with the second hinge part 30. Side wall 31 has a bore 34 and side wall 32 has a coaxial bore 43 of the same diameter. The axis of the bores 34, 43 is arranged in parallel to the cover surface 33 and may have a distance of less than 50 mm from the center plane of the base plate 2 so that smaller mounting geometries are possible.

Different diameter cylindrical rollers 35, 36 are provided with axial bores 37, 38 therethrough which permits mounting of the cylindrical rollers 35, 36 between the side walls 31, 32. Side wall 31 has two bores 41, 42, and side wall 32 has two coaxial bores 39, 40. Roller 35 is rotatably held in the second hinge part 30 by shaft 56 disposed in bores 39, 41, and roller 36 is rotatably held in the second hinge part 30 by shaft 57 disposed in the bores 40, 42. The second hinge part 30 is preferably made from steel by casting, or milling. Hinge part 30 is positioned relative to hinge part 1 so that the rollers 35, 36 face the base plate 2 when the door of the motor vehicle is closed. The diameter of the rollers 35, 36 determines the required force for swivelling of the door, while the location of the rollers 35, 36 in the door-side hinge part 30 determines the kinematics of the door.

The arrangement of the rollers 35, 36 as well as their geometry may be changed according to vehicle type so that the desired vehicle kinematics are created. The invention also contemplates the possibility of establishing more catch positions of the vehicle door. This can occur by increasing the number of rollers 35, 36 e.g. 3 or 4 rollers.

A cylindrical hinge shaft 45 is fitted through the bore 5 of the leg 3, the bores 34, 43 of the second hinge part 30 and the bore 6 of the leg 4 so that the second hinge part 30 is rotatably disposed with respect to the first hinge part 1 between the legs 3, 4. On one end, the hinge shaft 45 is provided with a stop 46 and on its other end with devices for easily detachable axial fastening, e.g. a turned groove and a shaft seal (not shown) of journal 45 in the bores 34, 43, 5, 6.

Bores 50, 51 in the holding device 13 are used for mounting the holding device 13 on the base plate 2. The ends 19, 20 of the bending spring 18 are disposed in the self-lubricating bearing bushes 28, 29, such as metalloplast. Bearing bushes (not shown) are also provided on other contact points between bores and shafts of the door hinge with an integrated locking device.

The free ends 19, 20 of the bending spring 18 are tightly clamped in the cylindrical grooves 14, 15 of the base plate 2 by the holding device 13, so that the flat bending spring 18 extends at a constant distance in parallel to the plane of the base plate 2 and around the hinge part 1. Hinge part 30 is held by the hinge shaft 45 in the bores 34, 43 coaxially with respect to the bores 5, 6 of the legs 3, 4 of the hinge part 1.

Figure 3:
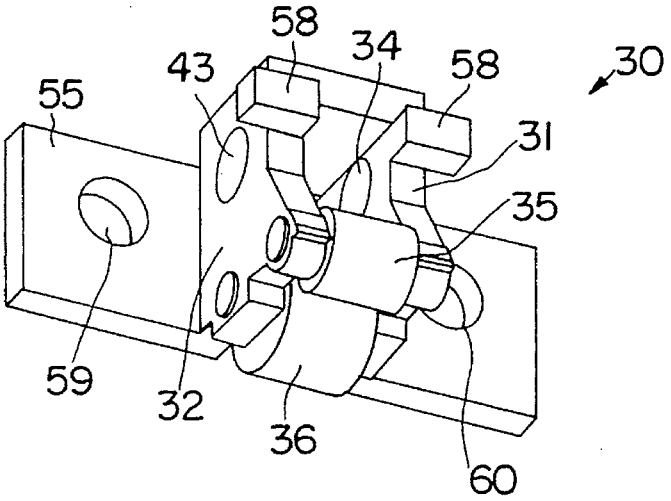
FIG. 3 is a perspective view of an alternative development of a hinge part of the door hinge according to FIG. 1.

FIG. 3 shows the second hinge part 30 with mounting plate 55 and bores 59, 60 for fastening to a door of a motor vehicle. Stops 58 on the side walls 31, 32 come to rest against the legs 3, 4 of the first hinge part 1 when the vehicle door reaches its end position. According to the invention, the stops 58 may be mounted on a door hinge without a locking device, when the door is held on the motor vehicle with two door hinges, With this arrangement, one door hinge part is provided with an integrated locking device and the second door hinge part has no locking device. Elements of this alternative which correspond to the elements described in the preceding figures are provided with the same reference numbers.

MOUNTING AND OPERATION OF THE DOOR HINGE

Mounting of the door hinge with the integrated locking device may take place in the center catch position of the vehicle door.

The hinge part 1 is fastened by means of screws in bores 7, 8 on a frame of a motor vehicle. Hinge part 30 is fastened on the door.

The door is positioned such that the hinge part 30 with the bores 34, 43 in the side walls 31, 32 is coaxial with respect to the bores 5, 6 of the legs 3, 4 of the hinge part 1, and the hinge shaft 45 extends through the bores 5, 34, 43, 6 so that the door-side second hinge part 30 with the door is rotatably held relative to the first hinge part 1 on the frame. However, the vehicle door may also be mounted on the vehicle together with the completely mounted hinge.

The retrofitting of the bending spring 18 may take place without dismounting of the door hinge by unscrewing the holding device 13 from the base plate 2. When the door is opened in the center position, the bending spring 18 is placed without prestress through the bearing bushes in grooves 14, 15 and is secured by the holding device 13. When the door is fully opened, the bending spring 18 transverse section 27 rests against the roller 35 with the smaller diameter, so that when the door swings, no noises are generated by the roller 35 of the locking device striking against the bending spring 18.

During closing of the door from the fully opened position, the roller 35 slides over the transverse section 27 against the resistance of the bending spring 18. The hinge part 30 moves from the fully opened position against a first increasing resistance and after overcoming a resistance maximum reaches an intermediate position relative to the hinge part 1 assisted by the bending spring 18. Here, the bending spring 18 rests against roller 36 as well as against roller 35. The intermediate position corresponds to a half-opened door. If the door is to be closed further, an increased force must be exercised on the door until the apex of the roller 36 has rolled over the transverse section 27 of the bending spring 18. In the last small swivel range before closing, the closing movement of the door is assisted by the bending spring 18. In the closed position, the roller 36 rests against the transverse section 27 of the bending spring 18 so that, when the door is opened, the locking devices will generate no noise.

When the door is opened, the course of the force is reversed to that occurring during the closing.

The spring action of the locking device can be adjusted by sliding of the ends 19, 20 of the bending spring 18 axially with respect to the grooves 14, 15.

Figure 4:
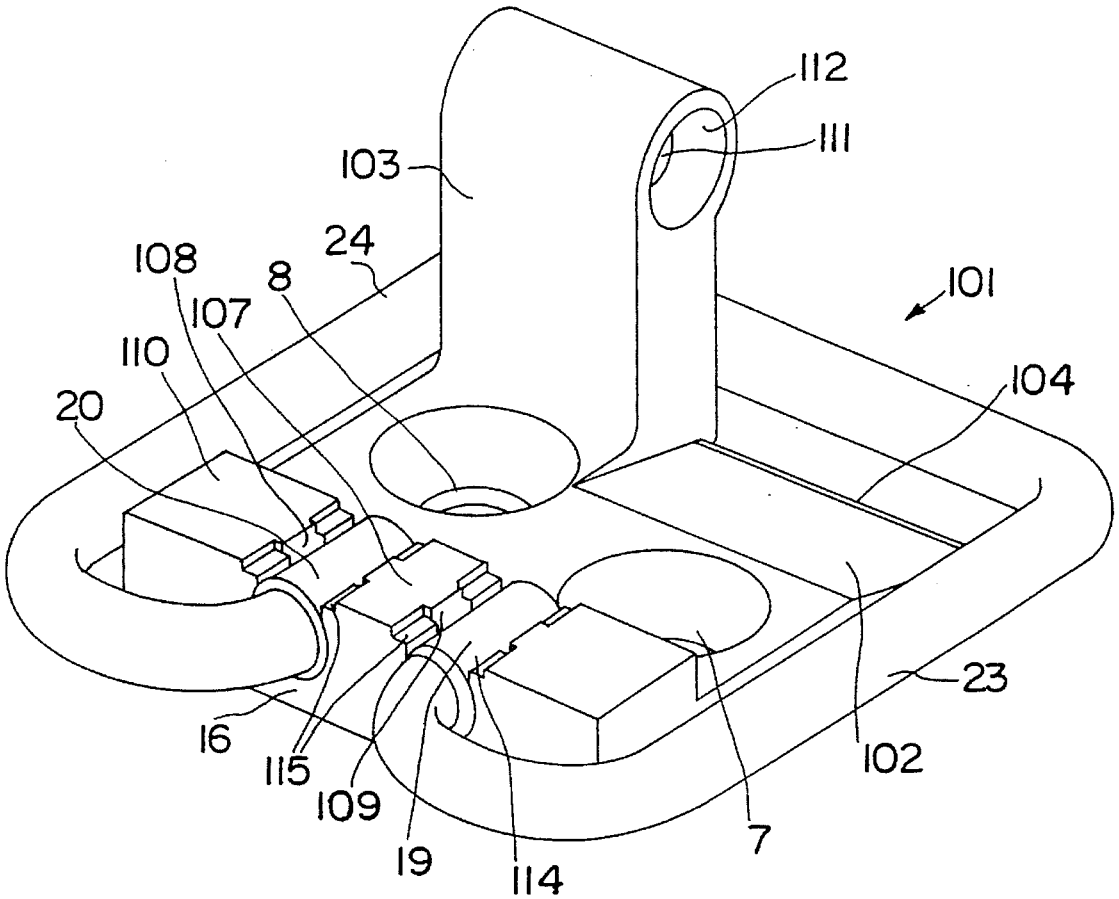
FIG. 4 is a perspective view of an alternative development of the door hinge with the integrated locking device.

FIG. 4 shows an alternative development of the invention wherein elements corresponding to the elements described in the preceding figures are provided with identical reference numbers. Here, an essentially rectangular base plate 102 of hinge part 101 is connected in one piece with a leg 103. The leg 103 rests against the circumference of the base plate 102. Perpendicularly to a center plane 104, the base plate 102 has bores 7, 8 for fastening the hinge part 101 to a door or to a frame of a motor vehicle. A head attachment 110 integrally formed with the base plate 102, increases the material thickness of the base plate 2 on side 16. In the area of the head attachment 110, U-shaped grooves 108, 109 are milled in from a top side 107 of the base plate 102, which grooves 108, 109 extend in parallel to one another and to the center plane 104 of the base plate 102 and perpendicular to side 16. The hinge part 101 is preferably made of cast steel, but can be made of plastic or sintered metal.

On its free end, the leg 103 is provided with a bore 111 which extends in parallel to side 16 and to the center plane 104 of the base plate 102 and ends with a cone 112. A hinge shaft with a conical section (not shown) is inserted into the bore 111 and extends through bores 34, 43 of a hinge part 30 and holds the hinge part 30 in a rotatable manner relative to the hinge part 1.

The free ends 19, 20 of the bending spring 18 are placed in the U-shaped grooves 108, 109 of the base plate 102. The free ends 19, 20 of the bending spring 18 in the grooves 108 109 are preferably each surrounded by a metallic sleeve 114. The edges of the grooves 108, 109 with the surface 107 are then worked (necked over) by a stamping tool for generating lips 115 after the bending spring 18 is inserted, so that the free ends 19, 20 of the bending spring 18 are held by means of the lips 115 in the base plate 102.

The hinge part 30 is fixedly disposed by a conical hinge shaft in the bore 111 with the cone 112, so that a lengthened cylindrical part of a hinge shaft is inserted into the cone 112. The cone 112 centers the hinge parts 101, 30 by the precisely fitting conical hinge shaft.

The hinge shaft may be held in the bore 111 on the rear side of the leg 103 by a locking screw on which a thick U-disk (not shown) is also situated. The rollers 35, 36 of the hinge 30 act upon the bending spring 18 in the hinge part 101 of this alternative development of the door hinge with the integrated locking device in a similar manner as described for FIGS. 1 and 2.

Although the present invention has been described and illustrated in detail, it is to be clearly understood that the same is by way of illustration and example only, and is not to be taken by way of limitation. The spirit and scope of the present invention are to be limited only by the terms of the appended claims.

I claim:

1. A door hinge with an integrated locking device for yielding positioning of a door at predetermined angles relative to a frame comprising:

a first hinge part having a base plate with integral, upstanding legs at or adjacent one end of the base plate;

a bending spring;

a second door-side hinge part having plural rollers attached thereto in a rotatable manner;

a hinge shaft for rotatably securing the second hinge part to the first hinge part;

wherein at least one of the plurality of rollers deforms the bending spring when the second hinge part is swivelled relative to the first hinge part;

wherein the bending spring is configured to have three U-shaped sections, a first U-shaped section comprising a transverse section positioned along the one end of the base plate and two parallel legs adjoining the transverse section at an approximate angle of 90°, a second U-shaped section connected to one of the parallel legs, and a 180° bend and with end leg extending therefrom, and a third U-shaped section connected to the other parallel leg and configured with a 180° bend and an end leg extending therefrom, the end legs being connected to an opposite end of the base plate;

wherein the two parallel legs of the bending spring extend essentially in parallel to sides of the base plate of the first hinge part; and wherein the bending spring is mounted to the first hinge part in an unstressed condition.

2. A door hinge with an integrated locking device according to claim 1, wherein the bending spring extends in a single plane.

3. A door hinge with an integrated locking device according to claim 1 wherein the end legs of the bending spring are parallel to one another in grooves in the base plate, and where the two parallel legs are spaced farther from one another than the end legs and entered around the base plate.

4. A door hinge with an integrated locking device according to claim 1, wherein the second hinge part is equipped with at least two rollers, which are each rotatably disposed thereon.

5. A door hinge with an integrated locking device according to claim 1, wherein the second hinge part has stops which contact the upstanding legs when the door is completely open.

6. A door hinge with an integrated locking device according to claim 1, wherein the first hinge part is made of any one of plastic and sintered metal.

7. A door hinge with an integrated locking device according to claim 1, wherein the second hinge part is fixedly clamped by a conical hinge shaft in a bore with a cone in the first hinge part.

8. A door hinge with an integrated locking device according to claim 1, wherein the end legs of the bending spring are surrounded by self-lubricating metalloplast bushes located in grooves in the first hinge part.

9. A door hinge with an integrated locking device according to claim 1, wherein the bending spring is detachably connected to the base plate by a holding device.

10. A door hinge with an integrated locking device according to claim 1, wherein the base plate has grooves for receiving bushes holding the ends of the bending spring and wherein edges of the grooves are deformed after insertion of the ends of the bending spring, surrounded by the bushes, so that the bending spring is fixedly held in the bushes in the grooves.

11. A door hinge with an integrated locking device according to claim 1, wherein the ends of the bending spring can be adjustably mounted to the first hinge part in one of a plurality of different axial positions.

12. A door hinge with an integrated locking device according to claim 1, wherein the plurality of rollers are made of a self-lubricating material.

13. A door hinge with an integrated locking device according to claim 1, wherein the door-side second hinge part is provided with a mounting plate for attachment to a door.

14. Door hinge with an integrated locking device according to claim 1, wherein the rollers, their rotation surfaces, the spring and the mounting areas therefore, all have suitable surface coatings which are durably self-lubricating and corrosion-protecting.

* * * * *